US005391088A

United States Patent [19]

Tomchak et al.

[11] Patent Number: 5,391,088

[45] Date of Patent: Feb. 21, 1995

[54] SURFACE MOUNT COUPLING CONNECTOR

[75] Inventors: Michael J. Tomchak, Harrisburg; George R. Schmedding, Hummelstown; Albert Casciotti, Hershey, all of Pa.

[73] Assignee: The Whitaker Corporation, Wilmington, Del.

[21] Appl. No.: 21,837

[22] Filed: Feb. 24, 1993

[51] Int. Cl.[6] ..... H01R 23/02; H01R 13/03

[52] U.S. Cl. ..... 439/216; 439/502; 439/524; 439/638

[58] Field of Search ..... 439/207, 210, 211, 214, 439/216, 209, 6, 32, 33, 4, 501, 258, 586, 502, 215, 640, 638, 597, 598, 524

[56] References Cited

U.S. PATENT DOCUMENTS

| | | | |
|---|---|---|---|
| 3,659,247 | 4/1972 | Chaney et al. | 439/32 |
| 3,715,627 | 2/1973 | D'Ausilio | 361/643 |
| 4,176,896 | 12/1979 | Wehling | 439/502 |
| 4,770,641 | 9/1988 | Rowlette | 439/86 |
| 4,825,540 | 5/1989 | Kelly | 29/861 |
| 4,857,016 | 8/1989 | Benscoter et al. | 439/638 |
| 4,875,871 | 10/1989 | Booty, Sr. et al. | 439/210 |
| 4,961,713 | 10/1990 | McCracken et al. | 439/587 |
| 5,006,286 | 4/1991 | Dery et al. | 264/40.2 |
| 5,074,799 | 12/1991 | Rowlette, Sr. | 439/91 |

*Primary Examiner*—Gary F. Paumen
*Attorney, Agent, or Firm*—William B. Noll

[57] ABSTRACT

A coupling connector is disclosed that electrically interconnects conductors contained in components of modular systems such as modular wiring or strip lighting systems, or the like. The coupling connector includes a pair of connector ends interconnected by at least one conductor, the ends of which terminate in conductive gel. Each connector end is firmly attached to surfaces of the components to be interconnected so that the conductive gel contacts the conductors contained within the components where the conductors intersect the components surface. Moisture resistant seals are arranged to seal the areas of contact from the elements. A cover is provided which is removably attached to the two connector ends to provide a relatively rigid structure. The cover is removable to provide access for disassembling the coupling connector.

17 Claims, 6 Drawing Sheets

SURFACE MOUNT COUPLING CONNECTOR

The present invention is related to coupling connectors that are attachable to electrical components of modular systems for interconnecting conductors contained within the components.

BACKGROUND OF THE INVENTION

The electrical components industry has modularized many of its systems resulting in a need for efficient ways of interconnecting the system's components. Modular wiring systems, for example, usually comprise several lengths of standard wire modules or components that include conductors that must be interconnected. Such a system is disclosed in U.S. Pat. No. 3,715,627 which issued Feb. 6, 1973 to D'Ausilio. Strip lighting systems are another example of systems that have modular components that include conductors that must be electrically interconnected by some kind of interconnecting hardware. Such interconnecting hardware in use today is usually complex resulting in reliability problems and is costly to install and to maintain. Because these systems must be adaptable to many needs, it is important that their individual components be able to be interconnected in various geometric arrangements. What is needed is a coupling connector for interconnecting the electrical conductors of such system components that is relatively inexpensive to manufacture and simple to install.

SUMMARY OF THE INVENTION

The present invention is a coupling connector for electrically coupling conductors in a first electrical component with conductors in an adjacent second electrical component. The coupling connector includes a pair of connector ends, one of which is attached to the first electrical component and the other of which is attached to the second electrical component, each connector end including means for making electrical contact with the conductors of its associated electrical component. A first conductor is provided for interconnecting the means for making electrical contact of one of the connector ends with that of the other of the connector ends. A cover is arranged for attachment to each of the connector ends to substantially cover the first conductor during use, the cover being replaceably removable to permit attachment and detachment of the connector ends to their respective electrical components. The cover includes two end portions and a center portion, each end portion having means for engaging its respective connector end for securing the cover thereto.

DESCRIPTION OF THE PREFERRED EMBODIMENT

The coupling connector of the present invention can be advantageously utilized to interconnect the conductors of most any modular system where the components are installed on a permanent surface such as a wall or floor, including wiring systems, and the like. However, to facilitate understanding the present invention, it will be described here in terms of its application to a strip lighting system.

Figure 1:
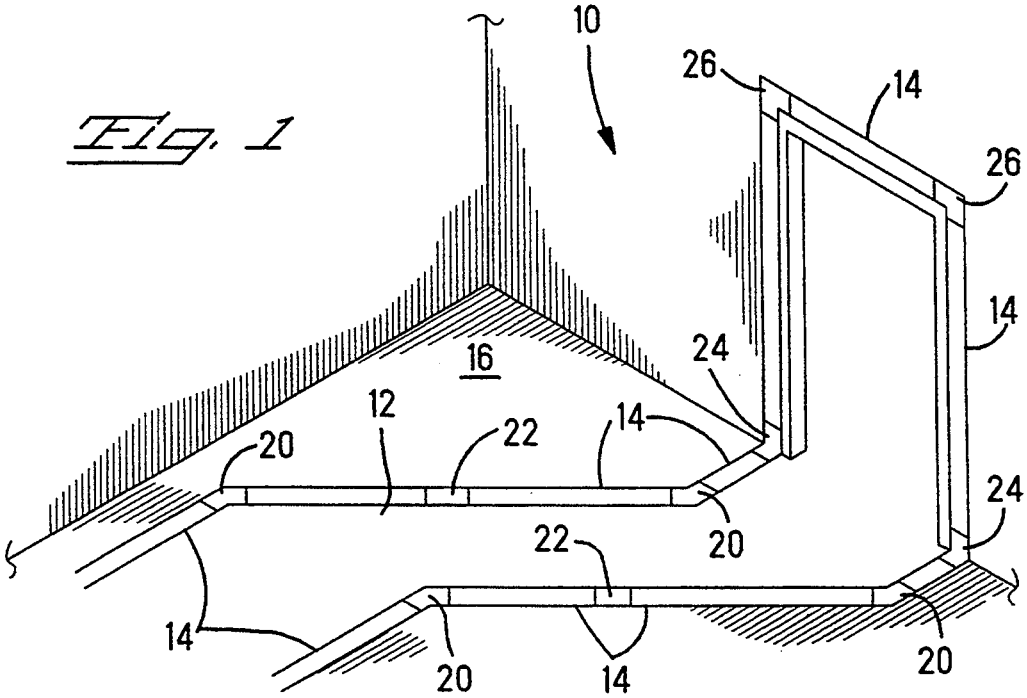
FIG. 1 an isometric view showing a typical application of the coupling connector of the present invention to electroluminescent strip lighting.

There is shown in FIG. 1 an electroluminescent strip light system 10 in a typical arrangement for defining a pathway 12 along a corridor. Individual lengths 14 of the strip light are arranged along the floor 16 and interconnected by means of coupling connectors 20, 22, 24, and 26. The individual lengths of strip light are secured to the floor 16 in a manner that is well known in the industry. Note that portions of the system may be associated with a wall or door frame to highlight an exit. Such systems are typically used in potentially hazardous situations where safe pathways for egress must be clearly marked, even when the primary lighting system fails. Applications for these systems include theaters, airport terminals, the aisles in aircraft as well as emergency exits, and off shore drilling rigs. Such diverse applications, of course, underscore the requirement that the lighting system be able to withstand substantial physical abuse and be insensitive to the elements. As shown in FIG. 1, the coupling connectors 20 through 26 can be angled, straight, or can even accommodate an inside corner. Additionally, rather long runs of the light strip are often needed, sometimes several hundred feet, so that individual standard lengths of the strip light must be coupled together to form these longer runs. With such long runs, the coupling connector is able to accommodate thermal expansion due to ambient temperature changes thereby functioning as an expansion joint as well as a coupling connector.

Figure 3:
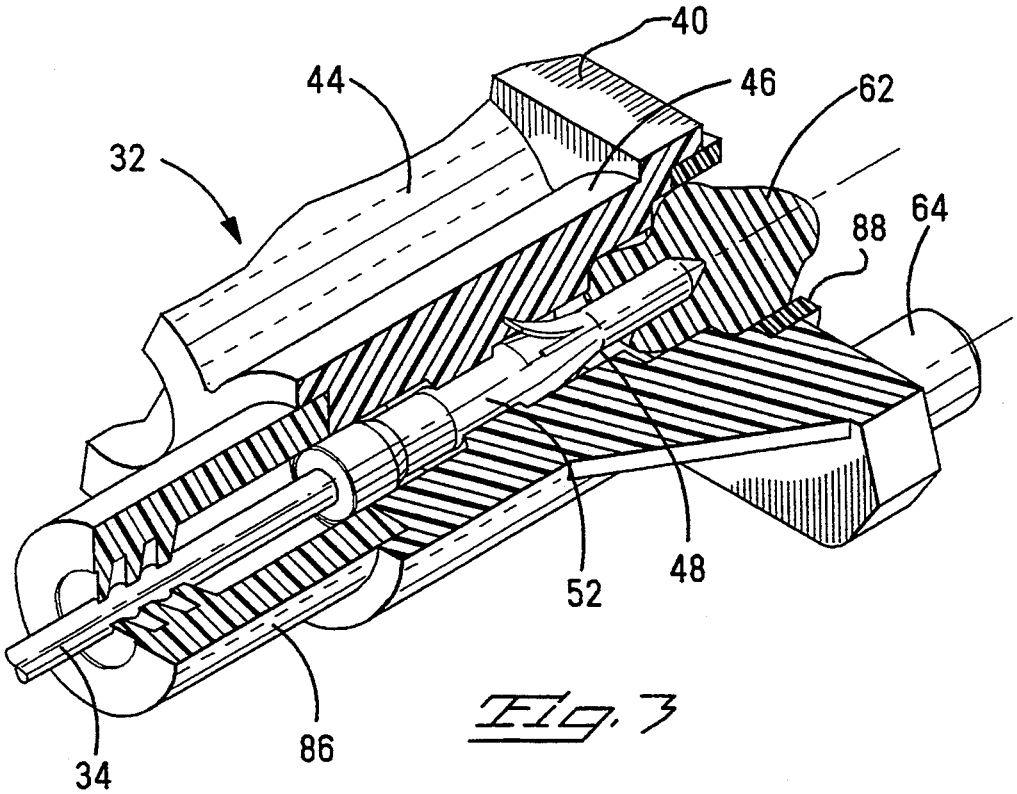
FIG. 3 is a view of a portion of FIG. 2 showing a terminated conductor in engagement with conductive gel.
Figure 2:
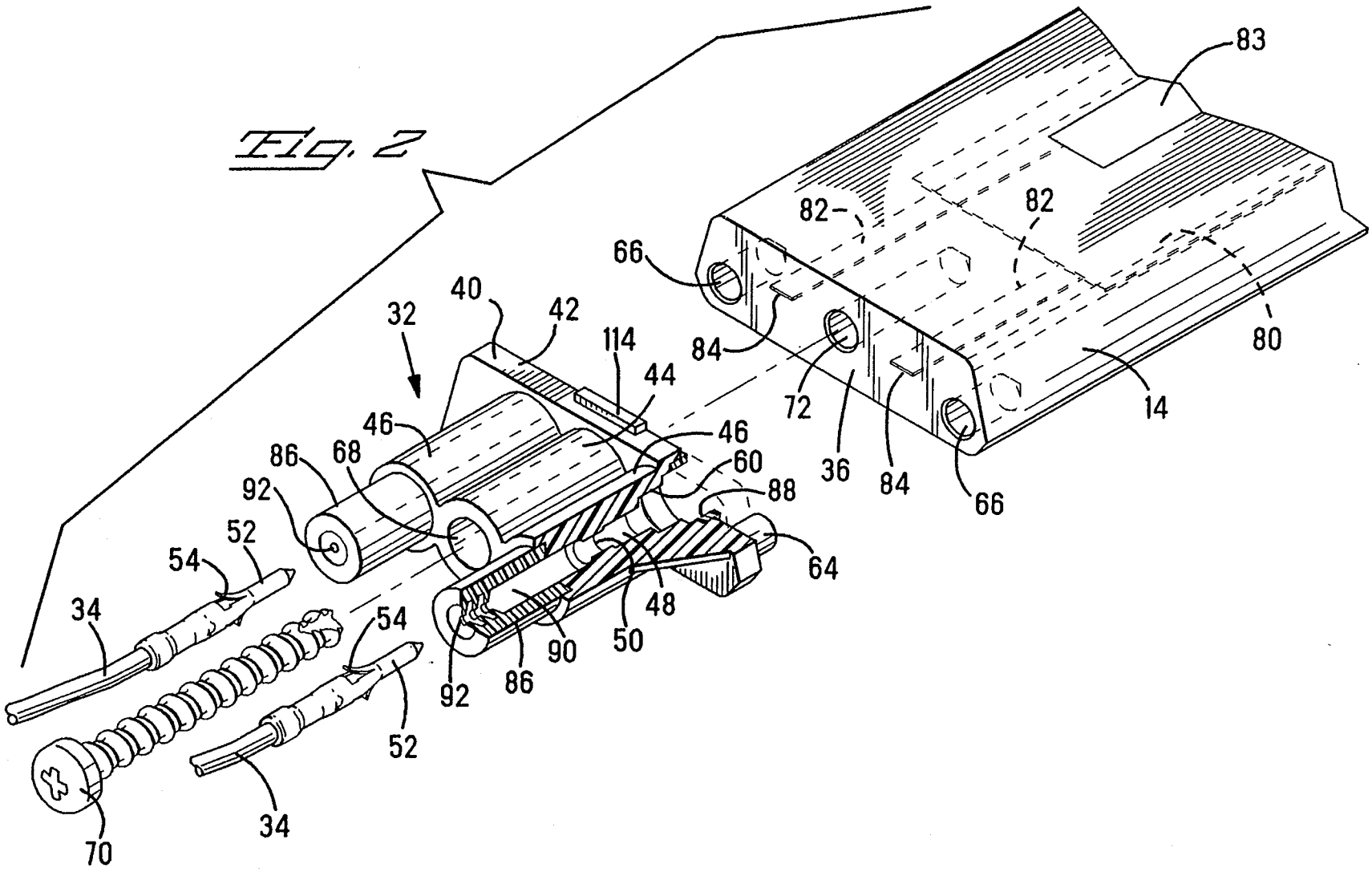
FIG. 2 is an isometric exploded parts view of one end of the coupling connector.
Figure 4:
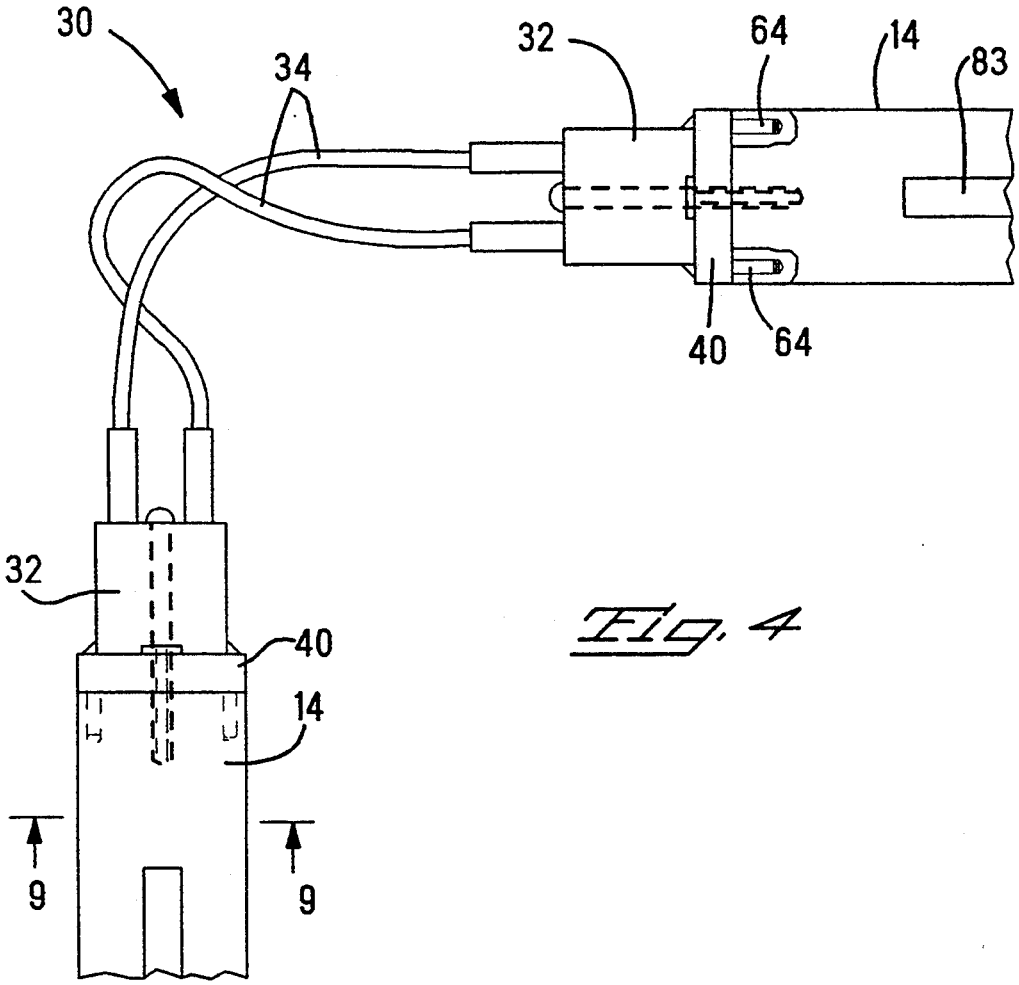
FIG. 4 is a plan view of the coupling connector arranged in a right angle configuration.

The detail structures of the coupling connector and the component light strip are best illustrated in FIGS. 2 3, and 4. In FIG. 4 there is shown a coupling connector 30 including two substantially identical connector ends 32 with a pair of interconnecting conductors 34. The two connector ends 32 are attached to the ends of two adjacent light strips 14. As shown in FIG. 2, an end 36 of a portion of the light strip 14 is shown ready to accept a connector end 32, which for illustrative purposes will be a right angle connector as shown at 26 in FIG. 1. The connector end 32 is molded plastic including a flange 40 having a mounting surface 42 for mounting against the end 36 of the light strip. Three bosses, including a central boss 44 and two outside bosses 46, extend from the flange in a direction opposite the mounting surface 42. Each of the outside bosses 46 has an opening 48 and internal shoulder 50 for receiving a terminal 52 which is attached to the conductor 34. The terminal 52 has a resilient barb 54 which yields as the terminal is inserted into the opening 48 and snaps into place against the shoulder 50 thereby holding the terminal and its conductor 34 captive within the connector end in the usual manner. Each of the openings 48 intersect a respective opening or counterbore 60 formed in the mounting surface 42. Each of the counterbores 60 are arranged to hold a quantity of conductive media such as conductive gel 62 in electrical contact with their respective terminals 52, as shown in FIG. 3. While in the present example conductive gel is the preferred conductive media, conductive elastomer or conductive polymer or other suitable material may be advantageously used in the practice of the present invention. A pair of spaced apart alignment pins 64 project from the mounting surface 42 and are arranged to engage a pair of mating holes 66 formed in the end 36 of the light strip 14. The central boss 44 has a hole 68 extending therethrough which intersects and is normal to the mounting surface 42. The hole 68 has clearance for a mounting screw 70 which engages a hole 72 in the end 36 of the light strip.

The light strip 14 includes a solid-state light element 80 shown in phantom lines in FIG. 2, and a pair of power conductors 82, also shown in phantom lines, that electrically connect to the light element. The outer surface of the light strip 14 is opaque, therefor, a window 83 of clear plastic is provided to emit the light. The power conductors 82 terminate at 84, flush with the surface 36. The connector end 32, with the conductors 34 and associated terminals 52 secured in the openings 48, is assembled to the light strip 14 by inserting the guide pins 64 into the holes 66 and bringing the mounting surface 42 into contact with the end 36. The mounting screw 70, which in the present example is self taping, is then inserted into the hole 68 and threaded into the hole 72 to tightly draw the flange 40 against the end 36. This causes the conductive gel 62 in each of the counterbores 60 to deform and come into electrical contact with the terminal points 84 of the power conductors 82. The counterbores 60 are large enough to accommodate any misalignment that may occur due to tolerance buildup during manufacturing thereby assuring good electrical contact with the entire ends of the power conductors. The counterbores are sized to accept a specific volume of the conductive gel so that when assembled, the gel is forced into contact with the power conductors. Since the conductive gel completely covers the entire ends of the power conductors 82, the conductors are protected from possible contact with potentially corrosive substances or other contamination that may inadvertently enter the connector. This forced contact is maintained even when, as under harsh operating conditions, the light strip and coupling connector are bumped or caused to move slightly with respect to their mounting surfaces. This use of conductive gel to contact only the ends of the power conductors results in a simplified preparation procedure for the strip light. It need only be sheared to length and the connector end attached to the sheared end as set forth above. Such conductive gels are well known in the industry. For an example of an application of a conductive gel please see U.S. Pat. No. 4,770,641 which issued Sep. 13, 1988 to Rowlette, the teachings of which are incorporated herein by reference. It should be noted that the structure of the coupling connector 30 permits it to be surface mounted and securely attached to any reasonably smooth surface of a component having conductors intersecting the surface.

As was set forth above, the coupling connector 30 must withstand harsh environmental conditions. Accordingly moisture resistant seals are provided to seal both the conductors 34 and the conductive gel 62. These seals include a pair of cylindrically shaped conductor seals 86 attached to each connector end 32, as best seen in FIG. 2, and a pair of ring shaped seals 88 attached to their mounting surfaces 42. The ring shaped seals 88 are set into recesses formed in the counterbores 60 so that when the connector end 32 is fully drawn against the end 36 by tightening the screw 70 to a predetermined torque value, the seals deform and are in sealing engagement therewith. In this position there is a slight gap of about 0.010 to about 0.015 inch between the mounting surface 42 and the end 36 of the light strip 14. The seals 88 further serve to prevent cross contact between the conductive gel of adjacent cavities. The seals 86 each include a clearance opening 90 which is in axial alignment with the opening 48 and an entry opening 92 consisting of several relatively thin sections each of which has an opening that is smaller than the diameter of the conductor 34 and in alignment with the opening 48. Each section will seal against the conductor thereby increasing the reliability of the seal 86. Necessarily, the sealing portions of the seals 86 and 88 must be made of an elastomeric material so that they conform to the surfaces of the conductor 34 and the end 36 thereby providing a good moisture resistant seal. One way to manufacture these seals is to fabricate them separately as discrete elements, then attach them to the connecter end 32 by any suitable means such as adhesive or thermal bonding, such methods being well known in the industry. Another way to manufacture these seals, which has obvious advantages over the discrete element method, is by means of dual molding. This method allows the main body of the connector end to be molded of a relatively hard plastic material. Then, moving core pins or a gate in the mold which opens the mold cavities for the seals, inject the elastomeric material to mold the seals. This method provides a good chemical bond between the seals and the main body of the connector end resulting in a one-piece housing. The dual molding method and related apparatus is described in detail in U.S. Pat. No. 4,961,713 which issued Oct. 9, 1990 to McCracken et al. and is incorporated herein by reference.

Figure 5:
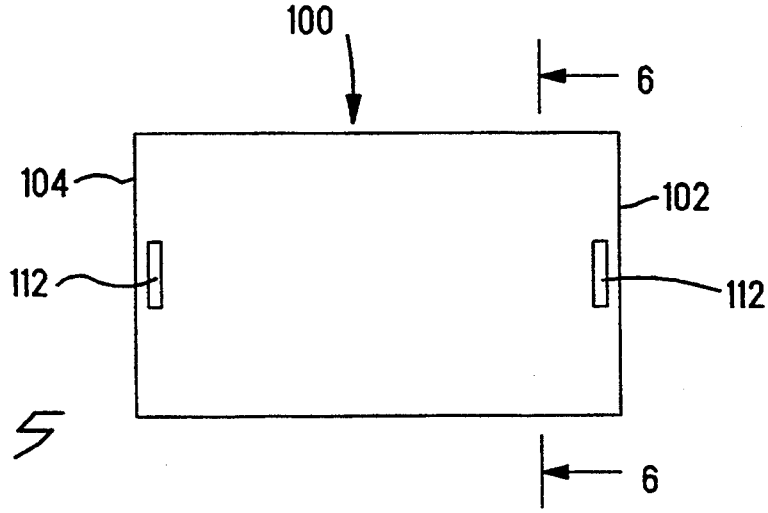
FIG. 5 is a plan view of a straight cover for the coupling connector.
Figure 6:
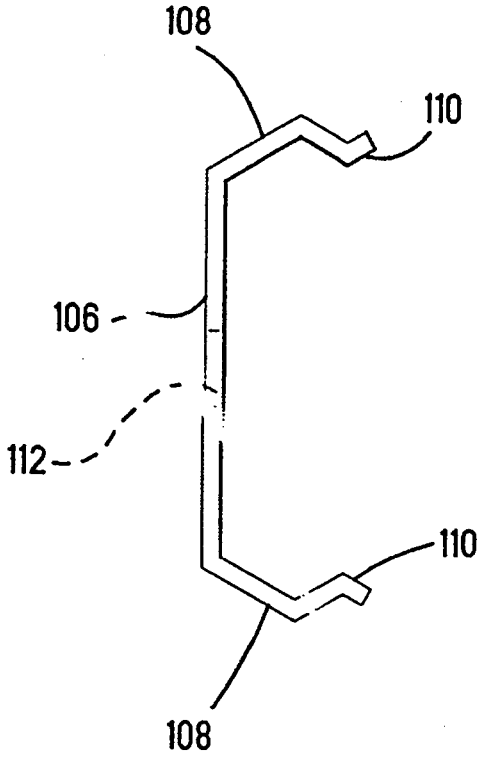
FIG. 6 is a cross-sectional view of the cover of FIG. 5 taken along the lines 6—6.
Figure 7:
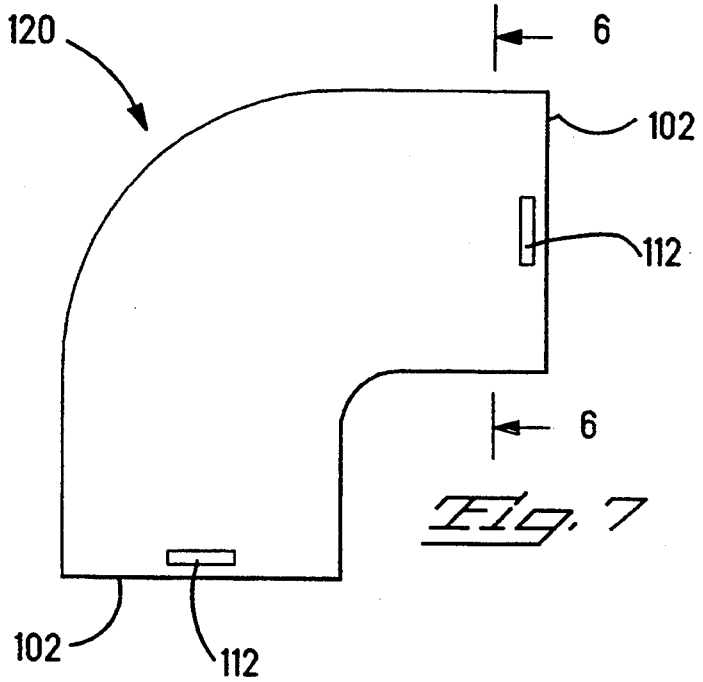
FIG. 7 s a view similar to that of FIG. 5 showing a right angle cover.
Figure 8:
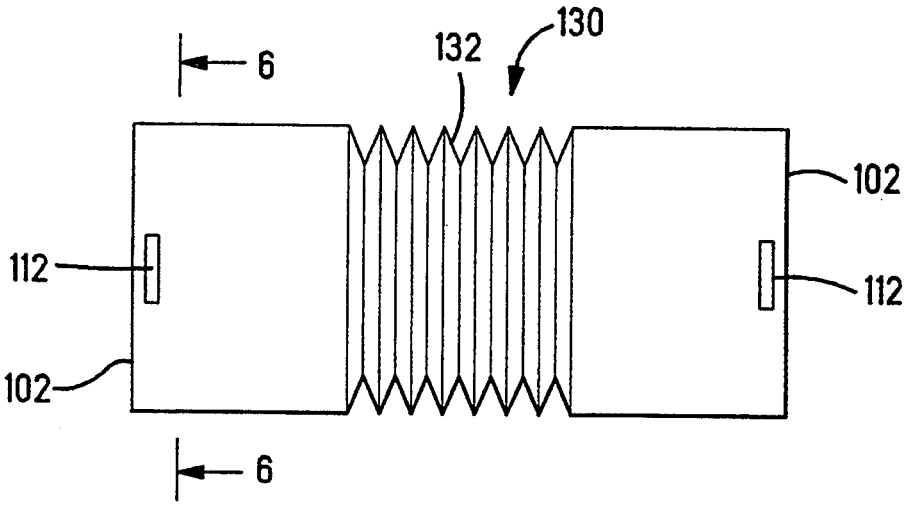
FIG. 8 is a view similar to that of FIG. 5 showing a flexible cover.

There is shown in FIGS. 5 and 6 a cover 100 of substantially rectangular shape having two opposite ends 102. The cover 100 has a cross-sectional shape substantially as shown in FIG. 6, including a relatively flat top portion 106 and a pair of side portions 108 that first angle outwardly, then inwardly to closely conform to the cross-sectional shape of the flange 40 of the connector end 32, which in turn substantially conforms to the shape of the light strip 14. While not essential, the ends 110 of the cover 100 may be turned outwardly a slight amount as shown to facilitate installation of the cover to the coupling connector 30. A pair of openings 112 are formed in the top portion 106, one near each end 102. These openings mate with tabs 114, one of which is molded into the top surface of each flange 40 as best seen in FIG. 2. The purpose of this tab will be explained below. There is shown in FIG. 7 an angled cover 120 that is substantially similar to the cover 100 except that the two ends 102 are positioned at 90 degrees to each other. The cover 120 has the same cross section as that shown in FIG. 6 and includes the openings 112 positioned near the ends 102. This cover is used with the coupling connector 30 in its right angle configuration as shown in FIG. 4 and at 26 in FIG. 1. The cover 120, however, may have its ends 102 positioned at any suitable angle that is required by the specific application. There is shown in FIG. 8 a flexible cover 130 which is similar to the cover 100 except that the center portion includes a bellows section 132 that is flexible and will permit the two ends 102 to be positioned at the desired angle. The bellows section is made of a resilient material to allow substantial flexibility. The cross section of the straight portions of the cover 130 is the same as that shown in FIG. 6.

Figure 9:
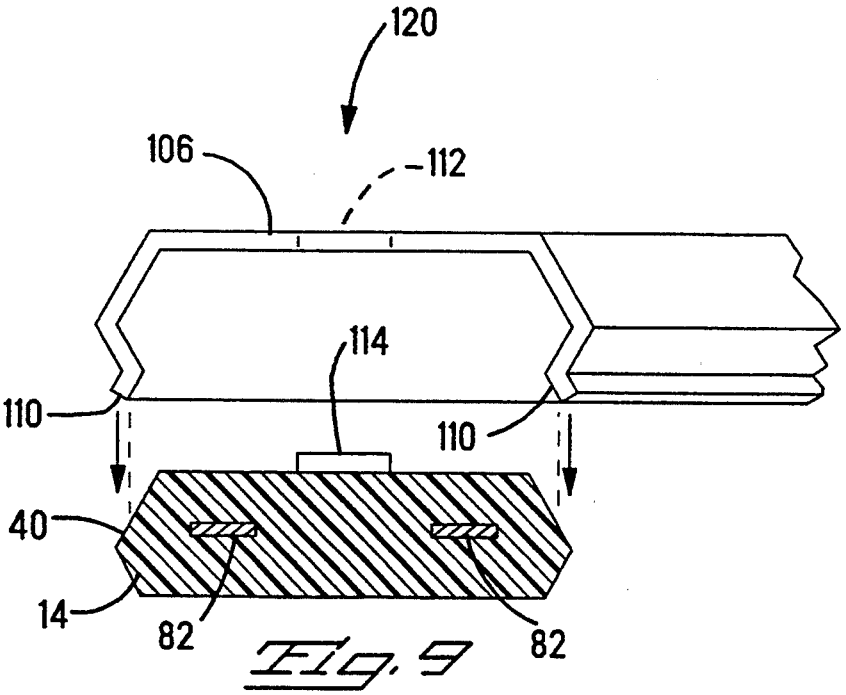
FIG. 9 is a cross-sectional view taken along the lines 9—9 of FIG. 4 showing the cover of FIG. 7 in position to be installed.
Figure 10:
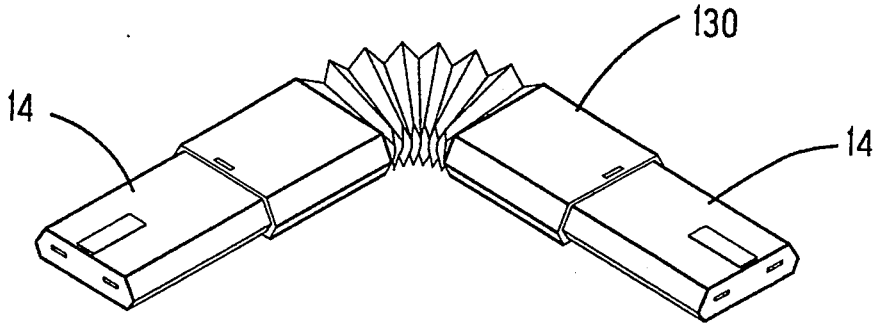
FIG. 10 is an isometric view showing the coupling connector of FIG. 4 with a flexible cover installed.

While the covers 100 and 120 as well as the straight portions of the cover 130 may be made of a somewhat rigid plastic material or metal, the top portion 106 and the sides 108 must be sufficiently flexible to permit installation of the cover to the coupling connector. To illustrate this, please refer to FIG. 9 where the angled cover is positioned directly above the flange 40 of the coupling connector 30 shown in FIG. 4. The cover 120 is then caused to move downwardly so that the ends 110 engage the upper surfaces of the flange 40, cam outwardly causing the top portion to bow slightly, then snap back around the flange 40. The tab 114 has entered the opening 112 thereby locking the two connector ends 32 to the cover 120 resulting in a rigid coupling connector assembly. FIG. 10 illustrates the use of the flexible cover 130 in a right angle application.

Figure 11:
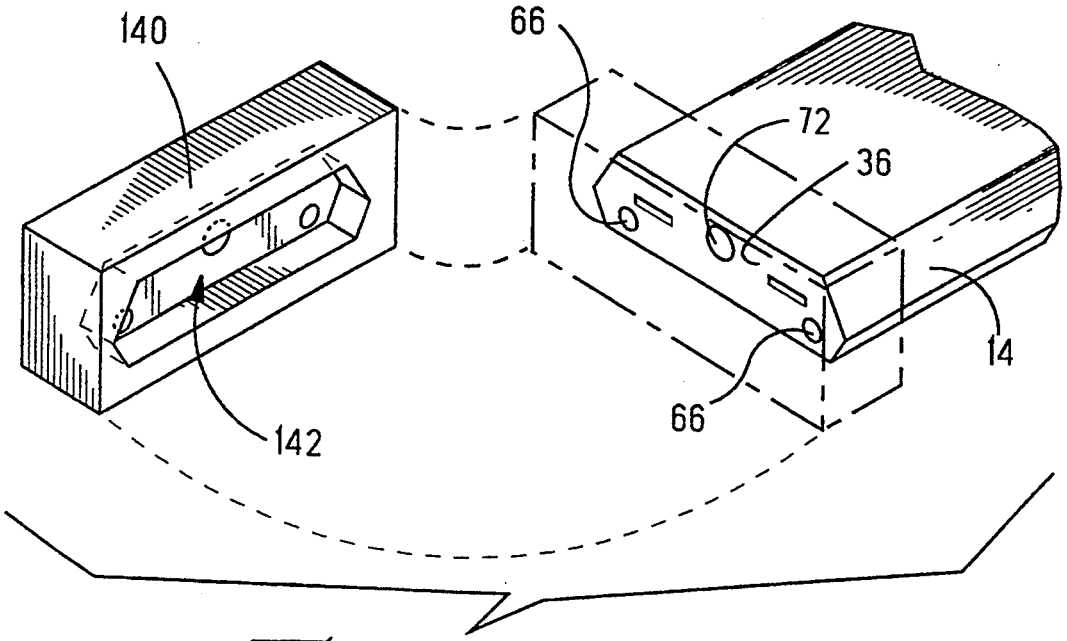
FIG. 11 is an isometric view showing a drill jig used for preparing the end of the component to receive the coupling connector.

There is shown in FIG. 11 a templet or drill jig 140 having a cavity 142 of a size and dimension so that it will slip over the end 36 of the light strip 14 without appreciable play. The jig 140 includes a central hole 144 and two holes 146 which are displaced to each side, these three holes being of substantially the same size and positional spacing as is desired for the holes 66 and 72 in the end 36 of the light strip 14. Prior to installing the coupling connector 130, the jig is positioned over the end 36 of one of the light strip sections and the three holes drilled into the light strip using the drill jig as a templet. This is repeated for the other light strip that is to be coupled. The coupling connector is then assembled to the two prepared ends of the light strips by inserting the guide pins 64 into their respective holes 66 and inserting the self tapping screws into the hole 68 and threading them into the holes 72 until the connector ends 32 are secured to their respective light strips and the seals 88 are in sealing engagement with the ends 36.

An important advantage of the present invention is the high reliability inherent in the coupling connector's structure, even in adverse environmental conditions. The seals protect the delicate areas of electrical contact and the contacts themselves, being made by conductive gel, are somewhat flexible and will withstand some movement between the coupling connector and the components being interconnected without breaking contact. Additionally, the present coupling connector is versatile and can be used in a variety of different positions by simply using an appropriately angled cover or using the flexible cover. This enhances its value without increasing its cost to manufacture or to install. In the case of light strips and modular wiring systems, the present coupling connector is able to maintain a low profile, substantially the same as the light strip itself. Another important advantage is that the seals are attached to the connector ends and seal directly against the conductors and the surface of the component. This obviates the need for sealing between the cover and the connector ends thereby eliminating the need for a very complex and costly cover. Additionally, with long runs of strip light, thermal expansion due to temperature variations are easily accommodated. Another important advantage is that during installation, the only preparation of the end of the strip light that is necessary is that it be sheared to length and the three holes drilled. Since actual electrical contact is made only to the exposed ends of the conductors, there is no unwanted insulation to strip away.

We claim:

1. A coupling connector for electrically coupling power conductors in a first light strip with power conductors in an adjacent second light strip for transmitting electrical power from the first to the second light strip comprising:

(a) a pair of connector ends, one of which is attached to said first light strip and the other of which is attached to said second light strip, each connector end including means for making electrical contact with the power conductors of its associated light strip, where said means includes a quantity of electrically conductive gel in electrical contact with a flexible conductor, said conductive gel being urged into electrical contact with the power conductors of one of said light strips when said connnector end is attached to said light strip;

(b) said flexible conductor interconnecting said means for making electrical contact of one of said connector ends with that of the other of said connector ends; and (c) a cover arranged for attachment to each of said connector ends to substantially cover said flexible conductor during use, said cover being replaceably removable to permit attachment and detachment of said connector ends to their respective light strips.

2. A coupling connector according to claim 1 including alignment means for aligning said conductive gel of each of said connector ends with its respective power conductor and attachment means for effecting said attachment of each said connector end to its respective light strip.

3. A coupling connector according to claim 2 wherein said alignment means includes a projection on said connector end and a mating opening in said light strip, and said attachment means includes a screw fastener threaded into a hole in said light strip.

4. A coupling connector according to claim 3 including a cavity in said connector end sized so that when said connector end is attached to said light strip said conductive gel is substantially confined by said cavity and forced into electrical contact with said power conductor.

5. A coupling connector according to claim 4, including a first moisture resistant seal attached to said connector end and arranged to engage said light strip for sealing said conductive gel and its contact point with said power conductor.

6. A coupling connector according to claim 5 wherein said cover includes two end portions and a center portion, each end portion having a locking member that engages a mating member on said connector end for securing said cover thereto.

7. A coupling connector according to claim 6 wherein said center portion is flexible so that said two end portions may be attached to their respective light strips when said first and second light strips are not parallel or are not in mutual axial alignment.

8. A coupling connector according to claim 1 wherein each said connector end includes an opening for receiving an end of said flexible conductor including means for securing said conductor in said opening said opening being in communication with said conductive gel so that when said flexible conductor is secured in said opening said conductor is in electrical engagement with gel.

9. A coupling connector according to claim 8 wherein said means for securing said conductor in said opening includes a lance associated with said conductor that interferingly engages a shoulder in said opening thereby securing said conductor therein.

10. A coupling connector according to claim 9 including a secured moisture resistant seal within said opening arranged to engage said flexible conductor for sealing said end of said flexible conductor and said conductive gel in contact therewith.

11. A coupling connector according to claim 10 wherein said second moisture resistant seal and said connector end are dual molded thereby providing a bond therebetween.

12. A coupling connector according to claim 11 wherein said lance is formed in a terminal which is secured to an end of said flexible conductor, said terminal being in electrical engagement with said conductive gel.

13. A coupling connector according to claim 12 wherein said cover includes two end portions and a center portion, each end portion having a locking member that engages a mating member on said connector end for securing said cover thereto.

14. A coupling connector according to claim 13 wherein said center portion is flexible so that said two end portions may be attached to their respective light strips when said first and second light strips are not parallel or are not in mutual axial alignment.

15. An environmetally sealed coupling connector system for electrically interconnecting power conductors to a light strip containing current carrying conductors, said coupling connector including a first housing having a pair of contact terminals electrically interconnected to power conductors at one end thereof, and at the opposite end a light strip mating face, where said light strip mating face includes a pair of recesses aligned with said contact terminals, said recesses containing a quantity of an electrically conductive gel, a light strip of a discrete length and containing a pair of parallelly arranged current carrying conductors disposed in a dielectric medium, said light strip having at its respective ends a contact face where said current carrying conductors are exposed to said face, whereby as said mating face is brought into contact with said contact face said conductive gel is urged into electrical contact with said exposed current carrying conductors, and a cover arranged for attachment to said coupling connector to substantially cover said power conductors and first housing during use, said cover being replaceably removable to permit attachment and detachment of said housing to a light strip.

16. The environmentally sealed coupling connector system according to claim 15, wherein an elastomeric sealing ring is provided within said recess to peripherally surround said conductive gel, where said sealing ring further projects beyond said contact face for abutting against a corresponding connector end.

17. The environmentally sealed coupling connector system according to claim 15, wherein said light strip is elongated having a substantially uniform cross-section throughout its length, and said coupling connector with said cover thereover has a comparable cross-section, whereby to exhibit a uniform and continuous assembly.

* * * * *